US011466407B2

(12) United States Patent
Claudon

(10) Patent No.: US 11,466,407 B2
(45) Date of Patent: Oct. 11, 2022

(54) MASKED COATING BLADE

(71) Applicant: BTG ECLÉPENS S.A., Eclépens (CH)

(72) Inventor: Alexandre Claudon, Cheseaux-Noréaz (CH)

(73) Assignee: BTG ECLEPENS S.A., Eclépens (CH)

( * ) Notice: Subject to any disclaimer, the term of this patent is extended or adjusted under 35 U.S.C. 154(b) by 0 days.

(21) Appl. No.: 16/088,626

(22) PCT Filed: Mar. 30, 2017

(86) PCT No.: PCT/EP2017/057581
§ 371 (c)(1),
(2) Date: Sep. 26, 2018

(87) PCT Pub. No.: WO2017/167904
PCT Pub. Date: Oct. 5, 2017

(65) Prior Publication Data

US 2019/0112765 A1 Apr. 18, 2019

(30) Foreign Application Priority Data

Mar. 31, 2016 (EP) ..... 16163276

(51) Int. Cl.
*D21H 23/34* (2006.01)
*B05C 11/04* (2006.01)
(Continued)

(52) U.S. Cl.
CPC ..... *D21H 23/34* (2013.01); *B05C 11/045* (2013.01); *D21G 3/005* (2013.01); *D21H 25/10* (2013.01)

(58) Field of Classification Search
CPC ..... D21H 23/34; D21H 25/10; B05C 11/045; D21G 3/005; B31F 1/145; B41N 10/005;
(Continued)

(56) References Cited

U.S. PATENT DOCUMENTS 6,431,066 B1 * 8/2002 Perez ..... B41F 31/027 101/157
2004/0033909 A1 * 2/2004 Yamaoka ..... B21D 22/201 508/138
(Continued)

FOREIGN PATENT DOCUMENTS

CN 1491136 A 4/2004
CN 1834343 A 9/2006
(Continued)

OTHER PUBLICATIONS

English Translation of DE102011115813, Hofleit, published Apr. 2013. (Year: 2013).*
(Continued)

*Primary Examiner* — Laura Edwards
(74) *Attorney, Agent, or Firm* — Brake Hughes Bellermann LLP

(57) ABSTRACT

In a general aspect, a coating blade for application of coating color to a fibrous web can include an elongate substrate having a longitudinal edge. Within an operating zone of the coating blade intended for contact with a coating color, the elongate substrate can include a longitudinal wear-resistant deposit adjacent to the longitudinal edge. The coating blade, within the operating zone, can also include a longitudinal masking deposit adjoining the longitudinal wear-resistant deposit.

17 Claims, 2 Drawing Sheets

(51) Int. Cl.
*D21H 25/10* (2006.01)
*D21G 3/00* (2006.01)

(58) Field of Classification Search
CPC ..... B41F 9/1072; B41F 31/04; B26B 21/60; B29C 64/214
USPC ..... 118/123; 428/192
See application file for complete search history.

(56) References Cited

U.S. PATENT DOCUMENTS

| | | | | |
|---|---|---|---|---|
| 2004/0137261 | A1 | 7/2004 | Lunnerfjord et al. | |
| 2005/0172889 | A1* | 8/2005 | Bellmann | B05C 11/045 118/123 |
| 2006/0162881 | A1* | 7/2006 | Conn | B31F 1/145 162/111 |
| 2007/0158045 | A1 | 7/2007 | Sundqvist et al. | |
| 2009/0053423 | A1* | 2/2009 | Freti | B05C 11/04 427/451 |
| 2010/0062227 | A1* | 3/2010 | Garrec | C03C 17/2456 428/192 |
| 2010/0221438 | A1* | 9/2010 | Karlsson | B05C 1/0817 427/356 |
| 2013/0174779 | A1 | 7/2013 | Bischof et al. | |
| 2014/0137361 | A1 | 5/2014 | Etschmaier et al. | |
| 2017/0361564 | A1* | 12/2017 | Seymour | B31F 1/14 |

FOREIGN PATENT DOCUMENTS

| | | | | |
|---|---|---|---|---|
| CN | 202492766 | U | | 10/2012 |
| CN | 103649412 | A | | 3/2014 |
| DE | 102006001336 | A1 | | 7/2007 |
| DE | 102009029699 | A1 | | 3/2011 |
| DE | 102011115813 | | * | 4/2013 |
| EP | 1508628 | A1 | * | 2/2005 |
| GB | 2130924 | A | | 6/1984 |
| JP | H0347561 | U | | 2/1991 |
| JP | 3-64595 | A | | 3/1991 |
| JP | 2006161713 | A | | 6/2006 |
| JP | 2007330830 | A | * | 12/2007 |
| JP | 2012031549 | A | | 2/2012 |
| WO | WO92/17323 | | * | 10/1992 |
| WO | 98/26877 | A1 | | 6/1998 |
| WO | 00/48746 | A1 | | 8/2000 |
| WO | 02/066173 | A1 | | 8/2002 |
| WO | 2004/038098 | A1 | | 5/2004 |
| WO | 2013/133762 | A1 | | 9/2013 |

OTHER PUBLICATIONS

International Search Report and Written Opinion issued in Int'l Appln. No. PCT/EP2017/057581 dated Apr. 26, 2017, 8 pages.
Extended EP Search Report for EP Application No. 16163276.5, dated Aug. 3, 2016, 6 pages.

* cited by examiner

MASKED COATING BLADE

CROSS REFERENCE TO RELATED APPLICATIONS

This application is a national stage entry of PCT Application No. PCT/EP2017/057581, filed on Mar. 30, 2017, entitled "MASKED COATING BLADE", which claims the benefit of European Application No. 16163276.5, filed on Mar. 31, 2016, entitled "MASKED COATING BLADE", the disclosures of which are both hereby incorporated by reference in their entireties.

TECHNICAL FIELD

The present invention relates to a coating blade for application of coating color to a fibrous web.

BACKGROUND ART

In the art of coating paper, coating color is applied using a coating blade. Coating blades are known in the art also as doctor blades or scrapers, all of which will be referred to herein as coating blades. The coating blade is typically constituted by a steel substrate onto which a deposit has been applied. For the purpose of coating the paper, an excess of coating color liquid is applied to the surface of the paper and subsequently doctored off using the coating blade. The paper is usually supplied as a web, which is supported and fed by a backing roll during the application and doctoring of coating color. The coating blade applies a pressure on the coating color liquid. Pigment particles in the coating color fluid subject the coating blade to both abrasive and erosive wear.

It is known in the art to apply a wear-resistant deposit onto the steel substrate in order to extend the life time of coating blades. Worn out coating blades affect the quality of the coated paper in an unacceptable manner and need to be replaced. In case of a blade change the coating machine is either stopped for up to one hour, causing a productivity loss, or still operated during 5-10 minutes, in which period the paper produced needs to be scrapped. Replacement of coating blades are furthermore costly due to the need to "run in" a new coating blade for up to 30 minutes before it can be used to produce coated paper of acceptable quality.

Wear-resistant deposits are intrinsically hard and/or rigid, thus affecting the flexibility of the coating blade. The tendency in the art is to develop harder and more wear-resistant materials. Moreover, the global amount of applied material tends to increase. This strongly rigidifies the structure, resulting in limited blade flexibility (in the machine direction and in the cross/transversal direction). It is crucial that the coating blade is sufficiently flexible in order to adapt appropriately, at high machine speed, to the topography of the paper to be coated. In order minimize the effect of the deposit on the flexibility of the blade, the wear-resistant deposit normally covers only a relatively narrow area along a longitudinal edge of the substrate.

It has been found that an abrupt or steep transition at the upstream longitudinal boundary of the wear-resistant deposit, opposite to the longitudinal edge of the coating blade, from the surface of the wear-resistant deposit to the surface of the steel substrate negatively affects the surface quality of the paper coating. It is believed that one reason for this is an impact on the fluid dynamics of the coating color liquid caused by such transition.

JP 2007/330830A discloses a coating blade provided with a wear-resistant deposit for the application of coating color to paper. The wear-resistant deposit has a tapered shape giving a smooth transition between the surface of the wear-resistant deposit and the surface of the substrate.

Residues of coating color, typically having a high pigment concentration in a surrounding latex phase, tend however to stick to the deposit surface or blade surface upstream of the blade tip. Such residues, or "stickies", cause streaks in the paper coating and thus lead to quality issues.

For these and other reasons there is a need for development of coating blades for application of coating color to paper.

SUMMARY OF THE INVENTION

It is an object of the present invention to provide a coating blade for the application of coating color to a fibrous web, allowing for excellent coating quality and outstanding operational productivity. It is thus an object of the present invention to provide a coating blade having an operating zone intended for contact with a coating color, the operating zone being indisposed for affecting negatively the fluid dynamics in the coating color. It is another object of the present invention to provide a coating blade having an operating zone intended for contact with a coating color, the operating zone being indisposed of affecting negatively the flexibility of the coating blade. It is a further object of the present invention to provide such a coating blade having improved surface properties.

These objects as well as other objects of the invention, which should be apparent to a person skilled in the art after having studied the description below, are accomplished by a coating blade for application of coating color to a fibrous web, the coating blade comprising an elongate substrate having a longitudinal edge, wherein within an operating zone intended for contact with a coating color of the coating blade, the substrate is provided with: a longitudinal wear-resistant deposit adjacent to the longitudinal edge; and a longitudinal masking deposit adjoining the longitudinal wear-resistant deposit. The masking deposit thus hides a part of the substrate from contact with the coating color. It is contemplated that the masking deposit has a lower elastic modulus than the wear-resistant deposit.

It was surprisingly found that by providing an operating zone of the coating blade with a wear-resistant deposit adjoined by a masking deposit the high requirements of paper coating can be met in that the coating blade during use has a long life-time, and provides a stable doctoring effect producing coated paper with excellent surface quality. The masking deposit is thus arranged on the substrate next to and joining the wear-resistant deposit. It is contemplated that the masking deposit extends over the substrate, next to the wear-resistant deposit, in a direction perpendicular to the longitudinal edge, for a substantially larger distance than the thickness of the masking deposit, such as for more than about 5 or more than about 10 times its thickness. The masking deposit consists of one or more layers.

The masking deposit preferably has a lower elastic modulus than the substrate. The substrate typically has an elastic modulus in the range of about 170-220 GPa. In order to not affect negatively the flexibility of the coating blade, the masking deposit typically has an elastic modulus of less than about 50 GPa, preferably less than about 20 GPa. The wear-resistant deposit typically has a higher elastic modulus than the substrate, such as higher than 220 GPa.

The masking deposit may comprise a polymer material. The polymer material may be a polyurethane material, typically an ester based, ether based or solvent based polyurethane material. The polymer material may alternatively be a polyepoxide, polysiloxane or acrylic polymer. Additives or fillers may be used to improve the mechanical properties of the masking deposit, without affecting negatively the elastic modulus of the masking deposit and/or the flexibility of the coating blade.

The masking deposit may taper towards the surface of the substrate. A tapered shape is preferred in order to minimize the amount of material used for the masking deposit. The tapered shape additionally improves the fluid dynamic properties of the coating color. The masking deposit may thus taper from a larger thickness near the wear-resistant deposit to a smaller thickness more remote from the wear-resistant deposit. The larger thickness is typically substantially similar to the thickness of the wear-resistant deposit. The masking deposit may taper at a constant rate from the larger thickness to the smaller thickness. The thickness of the masking deposit will thus decrease following a straight path from the larger thickness to the smaller thickness. Typically, however, the masking deposit will taper at varying rates from the larger thickness to the smaller thickness. As an example, the thickness of the masking deposit may decrease strongly near the wear-resistant deposit and weakly more remote from the wear-resistant deposit. The thickness of the masking deposit may thus decrease following a substantially curved path from the larger thickness to the smaller thickness. The masking deposit may taper over substantially its total width or over a narrow part of its width. The masking deposit typically tapers over about 5-95% of its width, preferably over about 50-90% of its width.

The transition between the surface intended for contact with the coating color of the wear-resistant deposit and the surface intended for contact with the coating color of the masking deposit is preferably substantially flush. The surface intended for contact with the coating color of the wear-resistant deposit may thus substantially level with the surface intended for contact with the coating color of the masking deposit at the transition.

The masking deposit may adjoin the wear-resistant deposit forming a substantially seamless surface intended for contact with the coating color. This surface may thus relate to a substantially smooth and/or continuous surface. This surface may furthermore, additionally or alternatively, relate to a surface free of substantial gaps and/or spaces between the wear-resistant deposit and the masking deposit.

A part of the masking deposit may overlap the wear-resistant deposit. The wear-resistant deposit may be partially or totally overlapped. A partial overlap may typically be narrow, such as less than about 1 mm, preferably covering essentially a steep or abrupt from the surface of the wear-resistant deposit to the surface of the steel substrate. In some embodiments, it may be advantageous that the overlap is wide, typically due to ease of manufacture. A wide overlap may cover a majority of operating zone. A wide or total overlap may provide the coating blade with alternative surface properties, may protect the wear-resistant deposit before and during "run-in" of the blade and may facilitate "run-in" of the blade.

The thickness of the masking deposit may be up to about 200 μm, preferably up to 100 μm. The thickness of the masking deposit may vary over the width of the deposit.

The width of the masking deposit may be in the range of about 5-30 mm, preferably of about 6-16 mm.

The wear-resistant deposit may comprise a ceramic material, such as a metal oxide, metal carbide, metal nitride or metal boride. Examples of suitable metal oxides are $Cr_2O_3$ and $Al_2O_3$. Examples of suitable metal carbides are WC and CrC. Examples of suitable metal nitrides are CrN and TiN. The metal carbides are typically present in a metal matrix, such as in a Ni-based or Co-based matrix. The wear-resistant deposit may comprise a cermet. In the present disclosure, a wear-resistant deposit relates to a deposit having a higher abrasive wear-resistance than steel. Furthermore, a wear-resistant deposit relates to a deposit having a higher erosive wear-resistance than steel.

The width of the wear-resistant deposit may be in the range of about 1-9 mm, preferably about 3-7 mm, more preferably about 4-6 mm. Alternatively, the width of the wear-resistant deposit is in the range of about 1-2.5 mm, preferably about 1.5-2.5 mm. By reducing the width of the wear-resistant deposit, and replacing part of it with the masking deposit, the flexibility of the coating blade increases (i.e. the rigidity of the coating blade decreases). The flexibility increase positively impacts the blade adaptability, leading to reduced "run in" time, improved process stability and higher quality of the coated paper.

The wear-resistant deposit may have a thickness of up to about 200 μm, preferably up to about 100 μm, typically where it covers an unbevelled part of the substrate. The thickness may vary over the width of the deposit. The deposit may typically be thicker, such as up to about 500 μm, where it covers a pre-ground bevel of the substrate and/or at the longitudinal edge of the coating blade.

The coating blade may be provided with the wear-resistant deposit by methods known in the art. The coating blade may be provided with the wear-resistant deposit by thermal spraying, preferably by HVOF (high velocity oxygen fuel) spraying or by APS (atmospheric plasma spraying). The raw material for the thermal spraying may be in the form of powder. The wear-resistant deposit may consist of one or more layers, as is customary in the art.

The wear-resistant deposit may be provided with at least one bevel. The width of the bevel is typically less than about 2 mm. The bevel may form an angle of about 0-45° with the substrate surface onto which the wear-resistant and masking deposits are arranged. The bevel of the wear-resistant deposit provides adaption of the coating blade to the backing roll. The substrate may have a pre-ground bevel in order for the bevel of the wear-resistant deposit to form when applying the wear-resistant material to the substrate. The bevel of the wear-resistant deposit may alternatively, or additionally, be obtained by grinding of the wear-resistant deposit.

The coating blade of the present invention may be a coating blade adapted for operation in bent mode (0-15° sliding angle towards the web) or stiff mode (15-45° sliding angle towards the web), as illustrated in FIGS. 4 and 5, respectively of GB 2 130 924. Exemplifying different configurations, the blade of FIG. 4 has a sliding bevel on the wear-resistant deposit but no pre-ground bevel on the substrate whereas the blade of FIG. 5 has both a sliding bevel on the wear-resistant deposit and a pre-ground bevel on the substrate.

The longitudinal wear-resistant deposit may adjoin the longitudinal edge of the substrate.

The substrate may be a steel substrate, such as a substrate of a carbon steel, for example spring steel, or of a stainless steel. The steel may be hardened, tempered or treated in other ways known in the art. The substrate may typically have a thickness in the range of about 0.3-0.7 mm. The width of the substrate may typically be in the range of about 70-100 mm. The length of the substrate may be up to about 12 meters.

The fibrous web may be a paper web. The fibrous web may, during application of coating color, be supported and fed by a backing roll. The fibrous web is contacted with coating color and a coating blade is used to doctor off excess amounts of coating color and ensure a correct metering of coating color.

The coating blade may have been provided with the masking deposit by methods known in the art, for example by a process similar to the one disclosed in WO 2000/048746. The masking deposit is typically provided after the wear-resistant deposit has been provided and may be provided before, during or at the end of further surface finishing, such as grinding and/or polishing, of the coating blade. Accordingly, the masking material is applied in a liquid state to the substrate at the back of the wear-resistant deposit. The masking deposit is thus typically not allowed to extend to the edge of the substrate at the tip of the blade. The viscosity and flow properties of the liquid masking material may contribute to the formation of a masking deposit having a shape that tapers from the surface of the wear-resistant deposit towards the surface of the substrate. Alternatively, a shape desired for the masking deposit may be obtained by grinding after solidification of masking material. The coating blade may alternatively have been provided with the masking deposit by spraying of a liquid masking material onto the substrate. When providing the masking deposit by spraying it is contemplated that part of the masking deposit may overlap the wear-resistant deposit, possibly all the way to the longitudinal edge of the coating blade.

As an example, the substrate of the coating blade may be provided with a wear-resistant deposit having a width of about 3-7 mm, preferably about 4-6 mm, and a masking deposit having a width of about 6-16 mm, preferably about 10-15 mm. Such arrangement gives rise to several advantages, some of which are accounted for herein. By adjoining the wear-resistant deposit with a masking deposit, an abrupt or steep transition, opposite to the edge of the coating blade, from the surface of the wear-resistant deposit to the surface of the steel substrate can be avoided in the vicinity of the blade tip without compromising with the blade flexibility. This leads to improved fluid dynamics of the coating color, leading in turn to an improved coating quality. Such an arrangement also allows for improved surface properties of the blade upstream of the blade tip.

As another example, the substrate of the coating blade may be provided with a wear-resistant deposit having a width of about 1-2.5 mm, preferably about 1.5-2.5 mm, and a masking deposit having a width of about 5-30 mm, such as 15-20 mm. By reducing the width of the wear-resistant deposit, and replacing part of it with the masking deposit, the flexibility of the coating blade increases (i.e. the rigidity of the coating blade decreases). This may lead to an improved metering effect and thus an improved surface quality of the paper coating, without compromising the wear-resistance of the coated blade or the fluid dynamics of the coating color. Such an arrangement also allows for improved surface properties of the blade upstream of the blade tip.

The features of the present invention described above may be applicable to invention taken alone or in any combination thereof.

BRIEF DESCRIPTION OF THE DRAWINGS

The invention will be described in the following with reference to the appended drawings.

DETAILED DESCRIPTION

Figure 1:
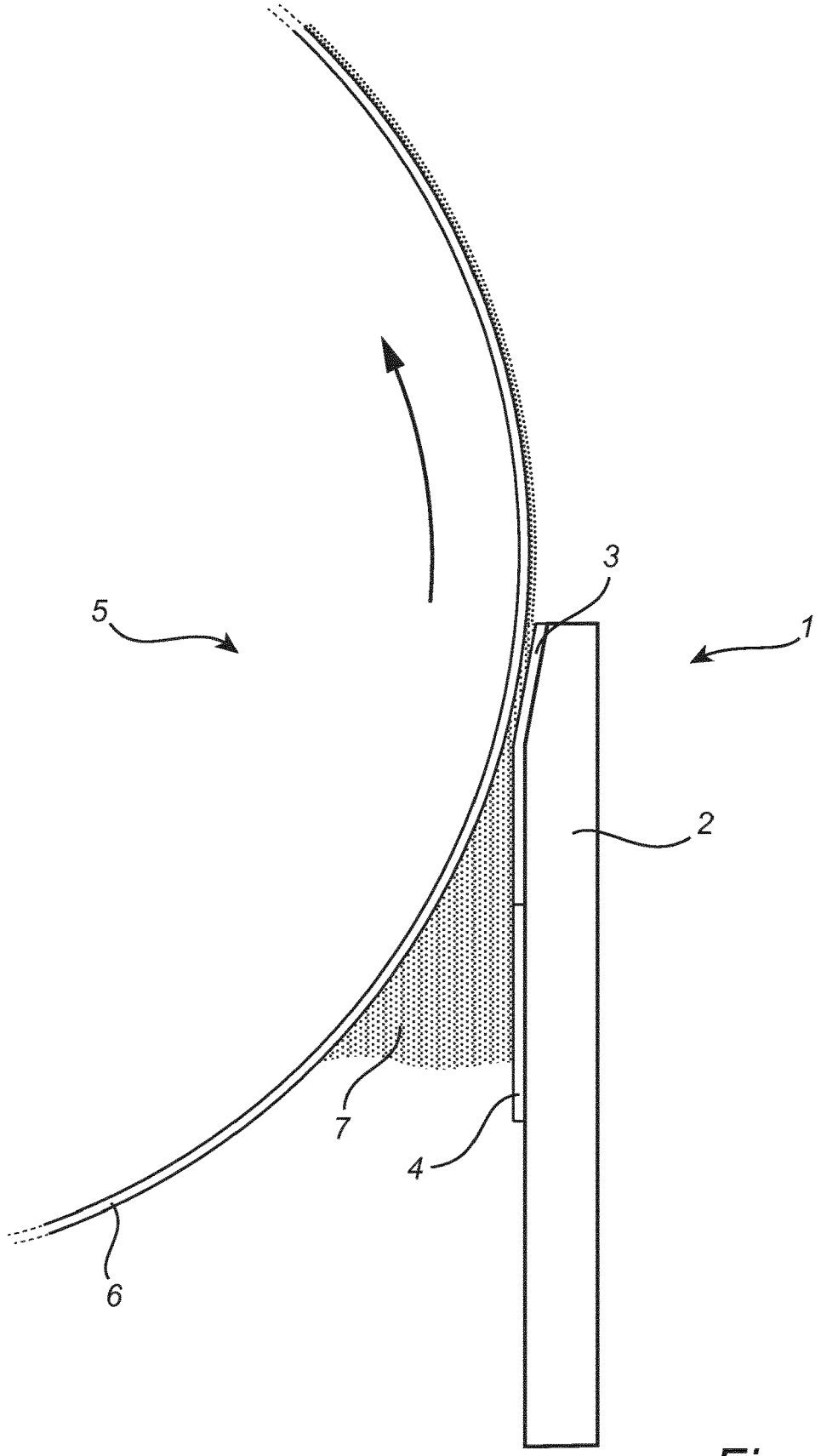
FIG. 1 shows diagrammatically in a side view a paper coating arrangement.

FIG. 1 shows a paper coating arrangement provided with a coating blade 1 having a substrate 2 with a wear-resistant deposit 3 and a masking deposit 4, to be further described in connection with FIGS. 2-6. Furthermore, the paper coating arrangement has a backing roll 5, rotating in the direction of the arrow, supporting and feeding a fibrous web 6, onto which coating color liquid 7 is provided. The coating color liquid 7 is provided in excess amounts. The coating blade 1 applies a pressure onto the coating color liquid 7, which causes excess amounts of coating color liquid 7 to be wiped, or doctored, off. The pressure applied by the coating blade 1 determines the amount of coating color fluid 7 that is applied to the fibrous web.

Figure 2:
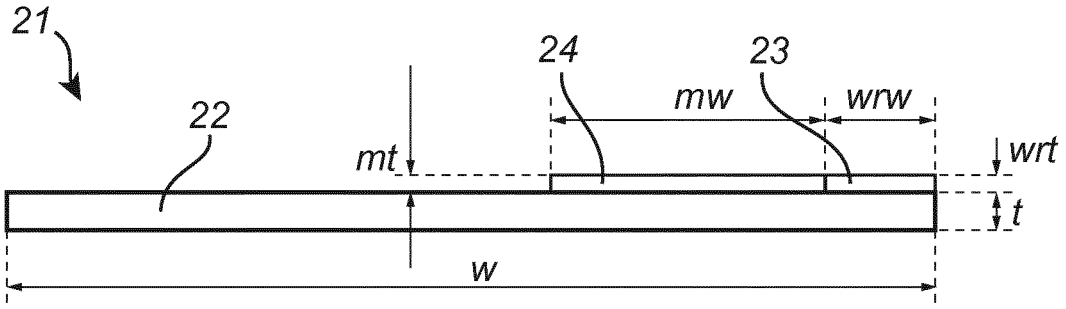
FIGS. 2-6 show diagrammatical side views of five different embodiments of masked coating blades.

FIG. 2 shows in a side view a masked coating blade 21 having a substrate 22 being provided with a longitudinal wear-resistant deposit 23 and a longitudinal masking deposit 24 adjoining the wear-resistant deposit 23. FIG. 2 furthermore illustrates schematically the thickness t and the width w of the substrate 22, as referred to herein. FIG. 2 also illustrates schematically the thickness wrt and width wrw of the wear-resistant deposit 23 and the thickness mt and width mw of the masking deposit 24, as referred to herein.

Figure 3:
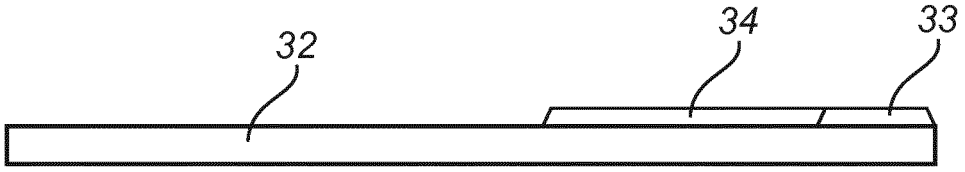

FIG. 3 shows an alternative arrangement wherein a part of the masking deposit 34 partially overlaps the wear-resistant deposit 33 in order to cover the steep transition from the surface of the wear-resistant deposit 33 to the surface of the substrate 32.

Figure 4:
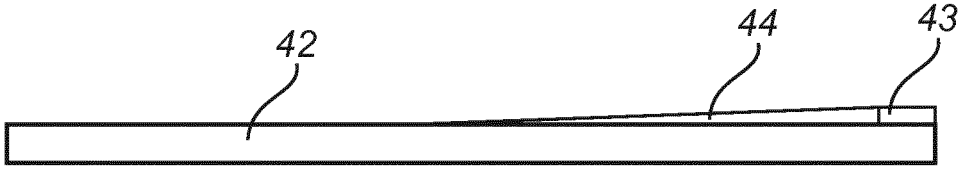

FIG. 4 shows an embodiment wherein the width of the wear-resistant deposit 43 has been reduced and the width of the masking deposit 44 has been extended. The masking deposit 44 tapers at a constant rate towards the surface of the substrate 42. The thickness of the masking deposit thus decreases following a straight path. The wear-resistant deposit 43 and the masking deposit 44 are shown without the masking deposit 44 overlapping the wear-resistant deposit 43, but the masking deposit may alternatively overlap the wear-resistant deposit.

Figure 5:
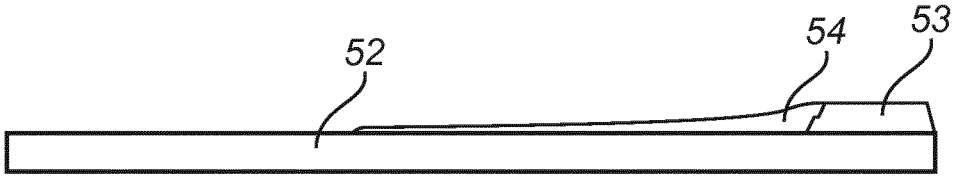

FIG. 5 shows an embodiment wherein the masking deposit 54 tapers along a curved path towards the surface of the substrate 52. The thickness of the masking deposit decreases strongly near the wear-resistant deposit 53 and weakly more remote from the wear-resistant deposit.

Figure 6:
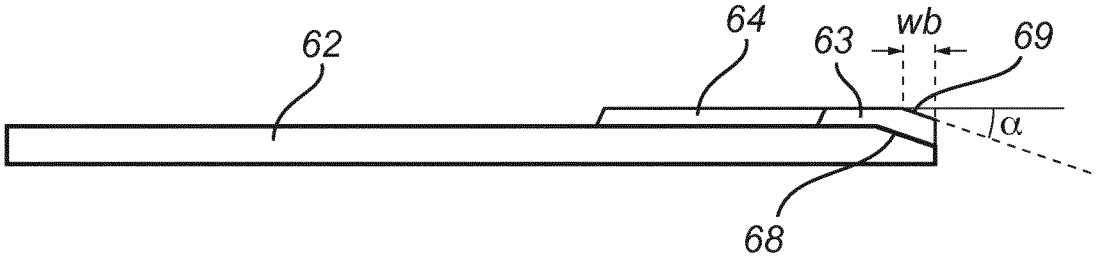

FIG. 6 shows an embodiment wherein the substrate 62 has a pre-ground bevel 68. The substrate 62 is provided with a wear-resistant deposit 63, extending over the pre-ground bevel 68, and an adjoining masking deposit 64. The wear-resistant deposit 63 has a sliding bevel 69. FIG. 6 also illustrates schematically the width bw of the sliding bevel 69 and the angle $\alpha$ between the sliding bevel 69 and the surface of the wear-resistant deposit 63, as referred to herein.

EXAMPLE

A reference coating blade was manufactured by providing a stainless steel substrate of 100 mm width and 0.457 mm thickness with a $Cr_2O_3$ based wear-resistant deposit of 5 mm width. A test coating blade according to the invention was manufactured by providing a stainless steel substrate of 100 mm width and 0.457 mm thickness with a $Cr_2O_3$ based wear-resistant deposit of 5 mm width and an adjoining polyurethane masking deposit of 15 mm width. The masking material was applied as a solvent based dispersion of methyl diphenyl diisocyanate (MDI) based polyurethane. The wear-resistant deposits had a sliding bevel of 10°.

The test and reference coating blades, respectively, were used to top-coat a paper web in a Jagenberg Combiblade coater at the following machine conditions and settings.

Coating Station Configuration:

Pre-coat (both paper sides—film press; 5-7 g/m$^2$)

Middle-coat (top paper side—coating rod; 7-8 g/m$^2$)

Top-coat (top paper side—bent blade; 9-10 g/m$^2$)

Machine speed: 800 m/min

Base paper: 150-180 g/m$^2$, 100% recycled fibers

Coating color: $CaCO_3$ 85%+clay 15%+latex binder (solids content 66-67%), viscosity 950 cPs The quality of the "mirror" (i.e. the appearance of the wet coated paper surface just after the blade) was noticed by the machine operators to be better for the test blade than for the reference blade. After 8 hours of operation, the blades were taken out of operation and washed. There was more build-up of coating color residues at the rear of the wear-resistant deposit on the reference blade than on the test blade. As concerns the test blade, the masking deposit was perfectly clean.

Visual inspection of the used test blade confirms that the polymeric masking deposit at the back of the ceramic wear-resistant deposit resisted to the friction of the coating color back flow during coating of the paper: no dissolution or change (chemical process), no wear (abrasion/erosion process) or delamination of the masking deposit has been noticed. The behaviour of the test blade has been similar to the reference blade regarding coating quality criteria.

ITEMIZED LIST

The coating blade according to the present invention can be defined according to the following itemized list.

1. A coating blade for application of coating color to a fibrous web, the coating blade comprising an elongate substrate having a longitudinal edge, wherein, within an operating zone, intended for contact with a coating color, of the coating blade, the substrate is provided with:

a longitudinal wear-resistant deposit adjacent to the longitudinal edge; and a longitudinal masking deposit adjoining the longitudinal wear-resistant deposit.

2. A coating blade according to item 1, wherein the masking deposit has a lower elastic modulus than the substrate.

3. A coating blade according to item 1 or 2, wherein the masking deposit has an elastic modulus of less than about 50 GPa, preferably less than about 20 GPa.

4. A coating blade according to anyone of the previous items, wherein the masking deposit comprises a polymer material.

5. A coating blade according to item 4, wherein the polymer material is polyurethane.

6. A coating blade according to any of the previous items, wherein the masking deposit tapers towards the surface of the substrate.

7. A coating blade according to any one of the previous items, wherein the transition between the surface intended for contact with the coating color of the wear-resistant deposit and the surface intended for contact with the coating color of the masking deposit is substantially flush.

8. A coating blade according to any one of the previous items, wherein the masking deposit adjoins the wear-resistant deposit forming a substantially seamless surface intended for contact with the coating color.

9. A coating blade according to any one of the previous items, wherein a part of the masking deposit overlaps the wear-resistant deposit.

10. A coating blade according to any one of the preceding items, wherein the thickness of the masking deposit is up to about 200 μm, preferably up to about 100 μm.

11. A coating blade according to any one of the previous items, wherein the width of the masking deposit is in the range of about 5-30 mm, preferably about 6-16 mm.

12. A coating blade according to any one of the previous items, wherein the wear-resistant deposit comprises a ceramic material, such as a metal oxide, metal carbide, metal nitride or metal boride.

13. A coating blade according to any one of the previous items, wherein the width of the wear-resistant deposit is in the range of about 1-9 mm, preferably about 3-7 mm, more preferably about 4-6 mm.

14. A coating blade according to any one of items 1-12, wherein the width of the wear-resistant deposit is in the range of about 1-2.5 mm, preferably about 1.5 to 2.5 mm.

15. A coating blade according to any one of the preceding items, wherein the thickness of the wear-resistant deposit is up to about 200 μm, preferably up to about 100 μm.

16. A coating blade according to any one of the previous items, wherein the wear-resistant deposit is provided with at least one bevel.

17. A coating blade according to any one of the previous items, wherein the longitudinal wear-resistant deposit adjoins the longitudinal edge.

18. A coating blade according to any one of the previous items, wherein the substrate is a steel substrate.

19. A coating blade according to any one of the previous items, wherein the fibrous web is a paper web.

The invention claimed is:

1. A coating blade for application of a coating color to a fibrous web, the coating blade comprising:

an elongate substrate having a width in a width direction between a first end and a second end of the elongate substrate, and a longitudinal edge at the first end, the elongate substrate, within an operating zone of the coating blade intended for contact with the coating color, includes:

a longitudinal wear-resistant deposit disposed on and in contact with the elongate substrate, the longitudinal wear-resistant deposit being adjacent to the longitudinal edge of the elongate substrate, the longitudinal wear-resistant deposit including a ceramic material and having a width in the width direction in a range of 1-9 millimeters;

a longitudinal masking deposit disposed on and in contact with the elongate substrate, the longitudinal masking deposit being next to, and adjoining the longitudinal wear-resistant deposit, the longitudinal masking deposit including a polymer material; and a transition, in the width direction, between a surface of the longitudinal wear-resistant deposit intended for contact with the coating color and a surface of the longitudinal masking deposit intended for contact with the coating color, the transition being substantially flush.

2. The coating blade of claim 1, wherein the longitudinal masking deposit has a lower elastic modulus than the elongate substrate.

3. The coating blade of claim 1, wherein the longitudinal masking deposit has an elastic modulus of less than 50 Gpa.

4. The coating blade of claim 1, wherein the polymer material is polyurethane.

5. The coating blade of claim 1, wherein the longitudinal masking deposit tapers towards a surface of the elongate substrate.

6. The coating blade of claim 1, wherein the longitudinal masking deposit adjoins the longitudinal wear-resistant deposit to define a substantially seamless surface intended for contact with the coating color.

7. The coating blade of claim 1, wherein a portion of the longitudinal masking deposit overlaps the longitudinal wear-resistant deposit.

8. The coating blade of claim 1, wherein a thickness of the longitudinal masking deposit is less than or equal to 200 μm.

9. The coating blade of claim 1, wherein a width of the longitudinal masking deposit is in a range of 5-30 mm.

10. The coating blade of claim 1, wherein a width of the longitudinal wear-resistant deposit is in a range of 1-2.5 mm.

11. The coating blade of claim 1, wherein a thickness of the longitudinal wear-resistant deposit is less than or equal to 200 μm.

12. The coating blade of claim 1, wherein the longitudinal wear-resistant deposit includes at least one bevel.

13. The coating blade of claim 1, wherein the longitudinal wear-resistant deposit adjoins the longitudinal edge.

14. The coating blade of claim 1, wherein the elongate substrate is a steel substrate.

15. The coating blade of claim 1, wherein the longitudinal masking deposit is arranged a distance from the longitudinal edge in the width direction.

16. The coating blade of claim 1, wherein the elongated substrate has a top surface extending between the first end and the second end, and wherein the longitudinal wear-resistant deposit and the longitudinal masking deposit are in contact with the top surface.

17. A coating blade for application of a coating color to a fibrous web, the coating blade comprising:

an elongate substrate having a width in a width direction between a first end and a second end of the elongate substrate, and a longitudinal edge at the first end, the elongate substrate, within an operating zone of the coating blade intended for contact with the coating color, includes:

a longitudinal wear-resistant deposit disposed on and in contact with the elongate substrate, the longitudinal wear-resistant deposit being adjacent to the longitudinal edge of the elongate substrate, the longitudinal wear-resistant deposit including a ceramic material and having a width in the width direction in a range of 1-9 millimeters; and a longitudinal masking deposit disposed on and in contact with the elongate substrate, the longitudinal masking deposit being arranged next to, and adjoining the longitudinal wear-resistant deposit at a distance of 1-9 millimeters from the longitudinal edge in the width direction, the longitudinal masking deposit including a polymer material and wherein the longitudinal masking deposit is arranged rearward of the longitudinal wear-resistant deposit in the width direction and with regard to the longitudinal edge.

* * * * *